US009683390B1

(12) United States Patent
Liu

(10) Patent No.: US 9,683,390 B1
(45) Date of Patent: Jun. 20, 2017

(54) COMBINATION LOCK ASSEMBLY

(71) Applicant: FEDERAL LOCK CO., LTD., Pingtung County (TW)

(72) Inventor: Tien-Kao Liu, Pingtung County (TW)

(73) Assignee: Federal Lock Co., Ltd., Pingtung County (TW)

( * ) Notice: Subject to any disclaimer, the term of this patent is extended or adjusted under 35 U.S.C. 154(b) by 0 days.

(21) Appl. No.: 15/051,826

(22) Filed: Feb. 24, 2016

(51) Int. Cl.

| | |
|---|---|
| ***E05B 37/02*** | (2006.01) |
| ***E05B 37/00*** | (2006.01) |
| ***E05B 17/14*** | (2006.01) |
| ***E05B 17/18*** | (2006.01) |

(52) U.S. Cl.
CPC ..... *E05B 37/025* (2013.01); *E05B 17/145* (2013.01); *E05B 17/185* (2013.01); *E05B 37/0003* (2013.01); *E05B 37/0058* (2013.01); *E05B 37/0062* (2013.01)

(58) Field of Classification Search
CPC ..... E05B 37/025; E05B 37/0062; E05B 37/0003; E05B 17/185; E05B 37/0058; E05B 17/145; E05B 17/186; E05B 17/14; E05B 37/02; E05B 37/0068; Y10T 70/308; Y10T 70/317; Y10T 70/325; Y10T 70/489; Y10T 70/493; Y10T 70/496; Y10T 70/498; Y10T 70/7305; Y10T 70/7966; Y10T 70/42; Y10T 70/439
USPC ..... 70/2–5, 20–23, 32–34, 51–56, 312, 70/423–428, 443, 455
See application file for complete search history.

(56) References Cited

U.S. PATENT DOCUMENTS

| | | | | | |
|---|---|---|---|---|---|
| 526,740 | A * | 10/1894 | Rapaport | E05B 37/025 | 70/141 |
| 4,111,014 | A * | 9/1978 | Epstein | E05B 37/025 | 70/25 |
| 4,354,367 | A * | 10/1982 | Wahl | E05B 37/02 | 70/333 A |
| 4,770,013 | A * | 9/1988 | Nakai | E05B 37/02 | 70/285 |
| 4,829,796 | A * | 5/1989 | Kim | B60K 15/0409 | 70/168 |
| 5,077,996 | A * | 1/1992 | Lien | E05B 17/145 | 292/346 |
| 5,953,940 | A * | 9/1999 | Ling | E05B 37/025 | 70/20 |
| 6,363,758 | B1 * | 4/2002 | Ling | E05B 37/025 | 70/22 |

(Continued)

*Primary Examiner* — Lloyd Gall
(74) *Attorney, Agent, or Firm* — Rosenberg, Klein & Lee

(57) ABSTRACT

A lock includes a housing in which a combination lock is received. The combination lock is unlocked when the combination unit of the combination lock is located at an unlocked position. The combination lock has a cam pin which is operated when the combination lock is unlocked and locked. A button is pushed to drive a cam which is located beside the combination lock. When the combination lock is locked, the cam pin is connected to the restriction hole to restrict the cam, and the latch is in its locked status. When the combination lock is unlocked, the cam pin is removed from the restriction hole. When the button is pushed, the cam is rotated to release the latch from the room of the housing. The combination of the combination lock can be changed by operating the operation bar when the combination lock is unlocked.

20 Claims, 15 Drawing Sheets

(56) References Cited

U.S. PATENT DOCUMENTS

| | | | | |
|---|---|---|---|---|
| 7,467,529 | B1 * | 12/2008 | Lai | E05B 35/105 70/18 |
| 2008/0110216 | A1 * | 5/2008 | Dalton | E05B 13/103 70/21 |
| 2008/0250825 | A1 * | 10/2008 | Lai | E05B 35/105 70/25 |
| 2009/0113947 | A1 * | 5/2009 | Lai | E05B 35/105 70/21 |
| 2009/0113948 | A1 * | 5/2009 | Ma | E05B 37/025 70/25 |
| 2010/0064738 | A1 * | 3/2010 | Yi | E05B 37/0034 70/24 |
| 2012/0186313 | A1 * | 7/2012 | Yang | E05B 13/103 70/284 |
| 2014/0026626 | A1 * | 1/2014 | Lai | E05B 37/0034 70/21 |

* cited by examiner

COMBINATION LOCK ASSEMBLY

BACKGROUND OF THE INVENTION

1. Fields of the Invention

The present invention relates to a hockey lock, and more particularly, to a hockey lock with a combination lock assembly.

2. Descriptions of Related Art

The conventional hockey locks are used for large doors or containers, and generally comprise a cylindrical body with a radial connection hole which has a core received therein. The core has a hook. The hockey lock has a lock hole which has a recess so that when the core is rotated, the hook is hooked to the recess to set the hockey lock to the locked status.

However, the core has to be operated by using a key, and this means that the managers have to carry the keys for multiple doors or containers. The keys are heavy and occupy a lot of space. When the managers want to open the doors or the containers, the correct key has to be identified from the multiple keys. Besides, the key hole of the hockey lock faces the door or the container, so that the hockey lock has to be pivoted an angle and the correct key has to be inserted into the key hole correctly to unlock the hockey lock. This is especially inconvenient during dark area. Once the correct key is lost or the key is copied, extra work has to be done to keep the doors or containers safe.

The present invention intends to provide a hockey lock that has a combination lock assembly which improves the shortcomings mentioned above.

SUMMARY OF THE INVENTION

The present invention relates to a hockey lock and comprises a housing 1 which is a cylindrical housing and has a lateral hole 11. A recessed portion 12 is defined in the housing 1 and communicates with the lateral hole 11. A cover 121 is connected to the housing 1 and seals the recessed portion 12. The housing 1 has a through hole 13, and a core recess 14 defined in one end of the lateral hole 11. A latch path 15 is defined radially in the housing 1 and communicates the room 14. A combination lock 2 has a combination unit and is received in the recessed portion 12. The combination unit has a portion thereof located corresponding to the lateral hole 11. The combination lock 2 has a cam pin 22 which is located at a first position when the combination lock 2 is in an unlocked status. The cam pin 22 is located at a second position when the combination lock 2 is a locked status.

A button 3 extends through the through hole 13. A first end of the button 3 in the housing 1 is connected to a cam 4 which is rotated by the button 3. The cam 4 is located beside the combination lock 2. The cam pin 22 is located corresponding to a restriction hole 41. The cam 4 is located corresponding to one side of the latch path 15. A latch 5 is located corresponding to the latch path 15 and has a locking portion 51. When the combination lock 2 is in the locked status, the cam pin 22 is located in the restriction hole 41 to restrict the cam 4, and the latch 5 is engaged with the room 14 and the cam 4 is stopped by the locking portion 51. When the combination lock 2 is in the unlocked status, the cam pin 22 is removed from the restriction hole 41, the cam 4 is rotated by pushing the button 3 and the cam 4 is not stopped by the locking portion 51, and the latch 5 is removed from the room 14.

Preferably, the button 3 is axially parallel to the axis of the cam 4. The first end of the button 3 has a guide face 31. The cam 4 is connected to a lock bolt 42 which is driven by the cam 4. The lock bolt 42 has an inclined face 421 which is located corresponding to the guide face 31. When the combination lock 2 is in the unlocked status, the button 3 is pushed, the guide face 31 contacts the inclined face 421 to push the lock bolt 42 which then rotates the cam 4.

Preferably, the lock bolt 42 has an elastic member 422 connected to the second end thereof. The elastic member 422 biases the lock bolt 42 and provides a recovery force to the lock bolt 42 so as to set the cam 4 at a position where the combination lock 2 is in the locked status.

Preferably, the cam 4 has a passive portion 43 which is located corresponding to the lock bolt 42. The lock bolt 42 has a passive member 423 located corresponding to the passive portion 43 which is engaged with the passive member 423.

Preferably, the combination lock 2 is received in a fixing base 6, wherein the fixing base 6 has at least one opening 61 in which the combination unit of the combination lock 2 is received. The at least one opening 61 is located corresponding to the lateral hole 11.

Preferably, the combination lock 2 is received in a fixing base 6, wherein the fixing base 6 has a bolt slot 62 and a reception slot 63 which communicate with the bolt slot 62 and the latch path 15. The lock bolt 42 is received in the bolt slot 62. The cam 4 is received in the reception slot 63. The fixing base 6 has a connection hole 64 which is located corresponding to the reception slot 63. The cam pin 22 extends through the connection hole 64.

Preferably, the fixing base 6 has a path 65 which communicates with the bolt slot 62 and the through hole 13. The button 3 extends through the path 65.

Preferably, the button 3 has a restriction area 32 which is located close to the guide face 31. A positioning portion 33 extends radially from the middle portion of the button 3. The fixing base 6 has a slit 66 defined therethrough which communicates with the path 65. The slit 66 has a fixing member 34 connected thereto which contacts between the restriction area 32 and the positioning portion 33. An elastic member 35 is biased between the positioning portion 33 and the fixing member 34.

Preferably, the fixing base 6 has a locking slot 67 and the reception slot 63 communicates with the latch path 15 via the locking slot 67. A lock member 44 is located in the locking slot 67. The cam 4 has a recess 45 defined radially therein and a dimple 451 is defined in the inside of the recess 45. The latch 5 has a head 53 which is located corresponding to the room 14. The latch path 15 has a stepped face 152. Another elastic member 54 is biased between the head 53 and the stepped face 152, and pushes the latch 5 in a direction away from the room 14. When the combination lock 2 is in the locked status, the dimple 451 is not located the locking slot 67, the lock member 44 contacts the recess 45 and is engaged with the locking portion 51 of the latch 5. When the combination lock 2 is in the unlocked status, the dimple 451 is moved by rotation of the cam 4 and located corresponding to the locking slot 67 so that the lock member 44 contacts the dimple 451 and is disengaged from the locking portion 51 of the latch 5.

Preferably, a slide 8 is slidably connected to the housing 1. When the slide 8 is located at a first position, the lateral hole 11 is closed by the slide 8, and the lateral hole 11 is opened when the slide 8 is located at a second position.

Preferably, the housing 1 has an assembling hole 17 and the slide 8 has a pivotal hole 81. A fixing pin 82 extends through the pivotal hole 81 and is connected to the assembling hole 17, the fixing pin 82 has an axial groove 821 and a torsion spring 822 is engaged with the axial groove 821 to provide a recovery force to the slide 8, the fixing pin 82 drives the slide 8 toward the first position.

Preferably, the housing 1 has a positioning hole 18 in which a positioning piece 181 is located. An elastic member 182 and a bead 183 are received in the positioning piece 181, wherein the bead 183 is biased by the elastic member 182 and protrudes from the positioning piece 181. When the slide 8 is located at the second position, the bead 183 contacts one side of the slide 8.

Preferably, the housing 1 has a recessed area 16 which faces a path that the slide 8 moves between the first position and the second position.

Preferably, the latch 5 has a restriction plane 521 which is located corresponding to one of the cam 4. The housing 1 has a pin 151 which is located corresponding to the restriction plane 521.

Preferably, the combination lock 2 is located in a fixing base 6, and the combination unit includes number disks 21. The combination lock 2 has a shaft 23 to which the number disks 21 are mounted. Each number disk 21 has an inner member 24 connected thereto. The inner member 24 has a flange 241 extending radially therefrom and the flange 241 has a flat portion 242. The fixing base 6 has an elastic unit 68 which is connected with a stop seat 25 to which the cam pin 22 is connected. The stop seat 25 has a protrusion 251 which is located corresponding to the flange 241 and the flat portion 242 of the inner member 24. The elastic unit 68 biases the stop seat 25 toward the inner member 24. When the combination lock 2 is in the locked status, the flange 241 contacts the protrusion 251 to move the stop seat 25 away from the inner member 24. The flat portion 242 faces the protrusion 251 so that the protrusion 251 is biased by the elastic unit 68 and contacts the flat portion 242 to move stop seat 25 to close to the inner portion 24, so that the combination lock 2 is unlocked.

Preferably, the inner member 24 has at least one lug 243 which is located at a position where the inner member 24 connects the number disk 21. The number disk 21 has teeth 211 defined in the inner periphery thereof. The teeth 211 are engaged with the at least one lug 243.

Preferably, the fixing base 6 has a pin hole 69 in which an operation bar 26 is received. The operation bar 26 is a cylindrical bar and includes a first stepped face 261 and a second stepped face 262. The length of the second stepped face 262 is shorter than that of the first stepped face 261. The pin hole 69 receives a push member 263 which is located close to the shaft 23 and extends from the second stepped face 262. The push member 263 contacts a side of the shaft 23. The stop seat 25 has a stepped portion 252 which is located corresponding to the first and second stepped faces 261, 262. The stepped portion 252 contacts the first stepped face 261 so that when the operation bar 26 is rotated, the push member 263 pushes the shaft 23, and the at least one lug 243 of the inner member 24 is disengaged from the teeth 211 of the number disk 21 when combination lock 2 is in the unlocked status. The shaft 23 has an elastic member 231 which biases the shaft 23 toward a direction such that the at least one lug 243 of the inner member 24 is engaged with the teeth 211 of the number disk 21.

Preferably, the shaft 23 has a cap 232 extending radially therefrom and the elastic member 231 of the shaft 23 is located between the number disk 21 and the cap 232 next to the number disk 21.

Preferably, the stop seat 25 has a passage 253 which has a restriction stepped face 254. The cam pin 22 has a flange 221 on the first end thereof. The flange 221 of the cam pin 22 is located corresponding to the restriction hole 41. An enlarged head 222 is connected to the second end of the cam pin 22. The enlarged head 222 extends through the passage 253. An elastic member 255 is located between the flange 221 of the cam pin 22 and the restriction stepped face 254.

Preferably, the number disks 21 each include multiple positioning slots 212 and a notch 213 which is a hook-shaped notch. Each number disk 21 has a positioning recess 214 in the outside thereof. The positioning slots 212 each are a V-shaped slot. A resilient plate 7 is connected to the fixing base 6 and has multiple pawls 71 which are located corresponding to the positioning slots 212 and the notch 213. Each pawl 71 extends at an angle relative to the resilient plate 7. The positioning slots 212 push the pawls 71 in two different rotational directions. The pawl 71 is contacts the inner wall of the positioning recess 214 when the number disks 21 rotate in one of the two different rotational directions.

The advantages of the present invention are that the combination lock has a combination lock received therein, when the number disks are rotated to the positions where the flat portions of the inner members face the protrusions, the protrusions are biased by the elastic units so as to contact the flat portions and located close to the inner members. Therefore, the cam pin is disengaged from the restriction hole of the cam. Then the user can push the button to rotate the cam, and the latch is disengaged from the room to unlock the lock. The user simply memorizes the combination without carrying any key.

After the combination lock is unlocked, the stop seat is located the second stepped face of the operation bar, so that the operation bar contacts the shaft to disengage the lugs of the inner member from the teeth of the number disk. After the new combination is set, the operation bar is rotated in reverse direction to engage the teeth of the number disks with the lugs of the inner members to complete the change of the combination. The safety feature is maintained without changing the lock core.

The stop seat has a passage in which the cam pin is received. An elastic member is located between the flange of the cam pin and the restriction stepped face so that when the cam is rotated by rotating the number disks, the elastic member provides a buffering feature to the stop seat. Therefore, any unauthorized person cannot guess the correction combination by hand touch.

The lock has a resilient plate, and the number disks have positioning slots and a notch. The pawls are engaged with the positioning slots or the notch to precisely position the number disks to prevent the number disks shift to loose their function. Besides, the notch extends in one direction and the disks each have a positioning recess so that the pawl is engaged with the positioning recess when rotating the number disk. The user can count the times of the engagement between the pawl and the positioning recess to acknowledge the number that the number disk is located.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
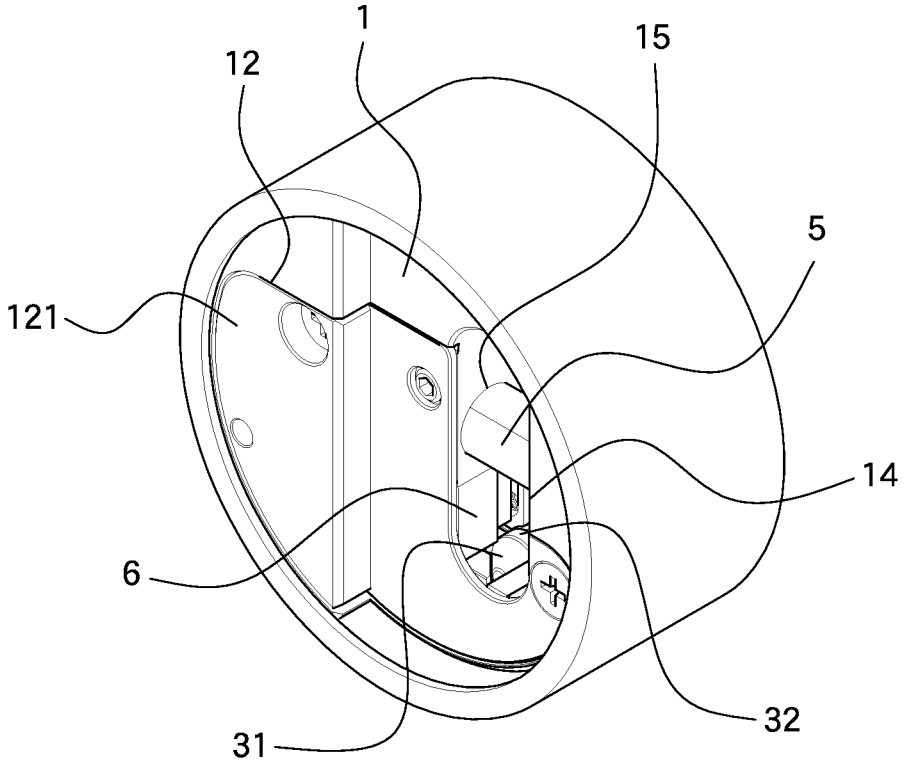
FIG. 1 is a perspective view to show the hockey lock of the present invention.
Figure 2:
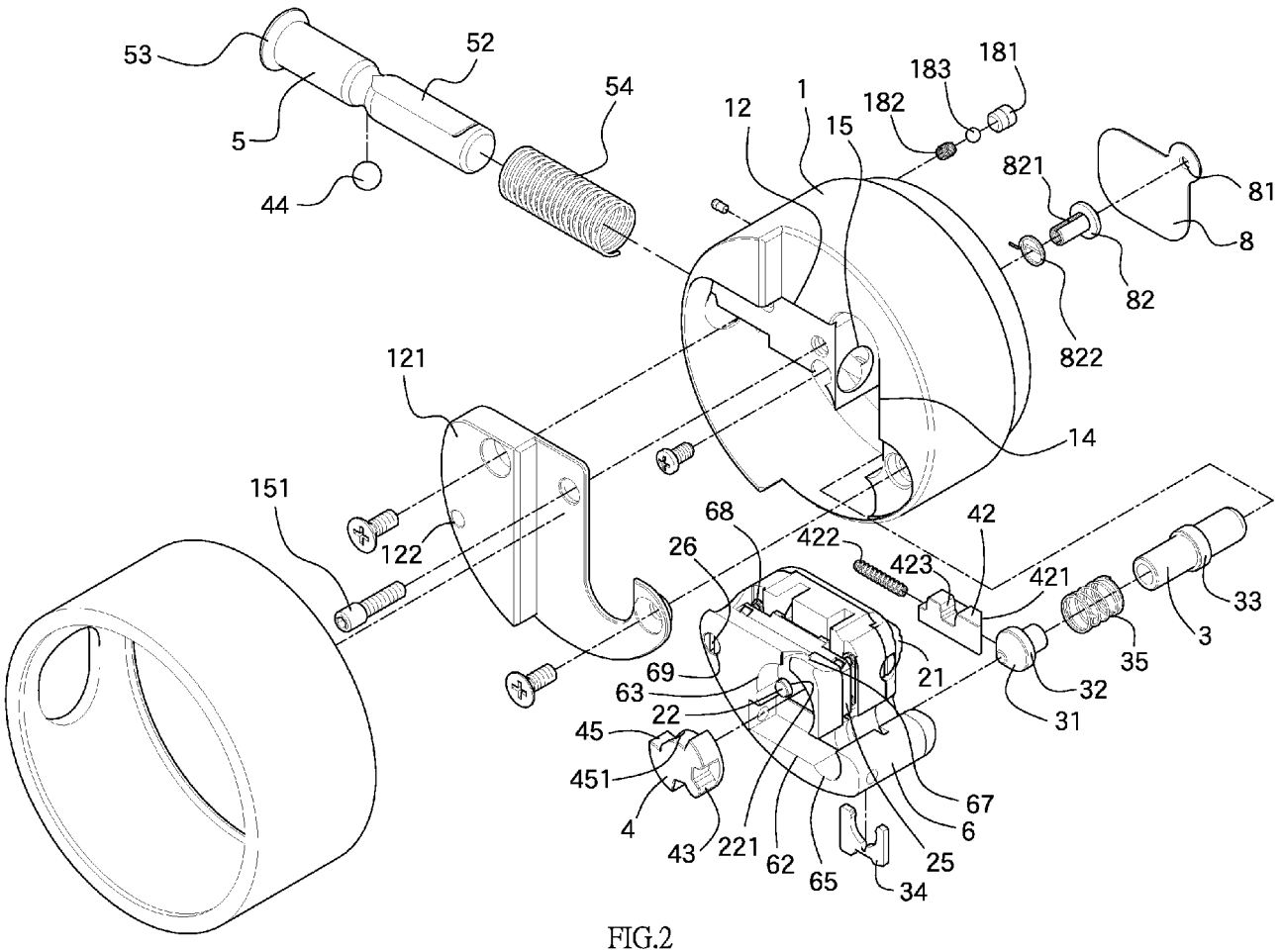
FIG. 2 is an exploded view of the hockey lock of the present invention.

Referring to FIGS. 1 and 2, the hockey lock of the present invention comprises a housing 1 which is a cylindrical housing and has a lateral hole 11. A recessed portion 12 is defined in the housing 1 and communicates with the lateral hole 11. A cover 121 is connected to the housing 1 and seals the recessed portion 12. The housing 1 has a through hole 13, and a room 14 defined in one end of the lateral hole 11. A latch path 15 is defined radially in the housing 1 and communicates the room 14. A combination lock 2 has a combination unit and is received in the recessed portion 12. The combination unit has a portion thereof located corresponding to the lateral hole 11. The combination lock 2 has a cam pin 22 which is located at a first position when the combination lock 2 is in an unlocked status. The cam pin 22 is located at a second position when the combination lock 2 is a locked status.

A button 3 extends through the through hole 13. A first end of the button 3 in the housing 1 is connected to a cam 4 which is rotated by the button 3. The cam 4 is located beside the combination lock 2. The cam pin 22 is located corresponding to a restriction hole 41. The cam 4 is located corresponding to one side of the latch path 15.

A latch 5 is located corresponding to the latch path 15 and has a locking portion 51. Preferably, the latch 5 has a restriction plane 52 which is located opposite to a surface corresponding to the cam 4. The housing 1 has a pin 151 which is located corresponding to the restriction plane 52.

In one embodiment, the button 3 is axially parallel to the axis of the cam 4. The first end of the button 3 has a guide face 31. The cam 4 is connected to a lock bolt 42 which is driven by the cam 4. The lock bolt 42 has an inclined face 421 which is located corresponding to the guide face 31. The lock bolt 42 has an elastic member 422 connected to the second end thereof. The elastic member 422 biases the lock bolt 42 and provides a recovery force to the lock bolt 42 so as to set the cam 4 at a position where the combination lock 2 is in the locked status.

In one embodiment, the cam 4 has a pinion portion or a passive portion 43 which is located corresponding to the lock bolt 42. The lock bolt 42 has a rack portion or a passive member 423 located corresponding to the passive portion 43 which is engaged with the passive member 423, thereby forming a rack and pinion between the lock bolt 42 and the cam 4. In one embodiment, the passive portion 43 and the passive member 423 are connected to each other by teeth.

In order to secure the button 3, the combination lock 2 and the cam 4. The hockey lock has a fixing base 6 which has at least one opening 61 in which the combination unit of the combination lock 2 is received. The at least one opening 61 is located corresponding to the lateral hole 11. The combination lock 2 is received in a fixing base 6, wherein the fixing base 6 has a bolt slot 62 and a reception slot 63 which communicate with the bolt slot 62 and the latch path 15. The lock bolt 42 is received in the bolt slot 62. The cam 4 is received in the reception slot 63. The fixing base 6 has a connection hole 64 which is located corresponding to the reception slot 63. The cam pin 22 extends through the connection hole 64. The fixing base 6 has a path 65 which communicates with the bolt slot 62 and the through hole 13. The button 3 extends through the path 65.

For positioning the button 3, the button 3 has a restriction area 32 which is located close to the guide face 31. A positioning portion 33 extends radially from the middle portion of the button 3. The fixing base 6 has a slit 66 defined therethrough which communicates with the path 65. The slit 66 has a fixing member 34 connected thereto which contacts between the restriction area 32 and the positioning portion 33. An elastic member 35 is biased between the positioning portion 33 and the fixing member 34. The elastic member 35 provides the recovery force to return the button 3 after the button 3 is pushed.

For the cam 4 and the latch 5, the fixing base 6 has a locking slot 67 and the reception slot 63 communicates with the latch path 15 via the locking slot 67. A lock member 44 is located in the locking slot 67. In one embodiment, the bead 44 is a steel ball. The cam 4 has a recess 45 defined radially therein and a dimple 451 is defined in the inside of the recess 45. The latch 5 has a head 53 which is located corresponding to the room 14. The latch path 15 has a stepped face 152. Another elastic member 54 is biased between the head 53 and the stepped face 152, and pushes the latch 5 in a direction away from the room 14.

Figure 3:
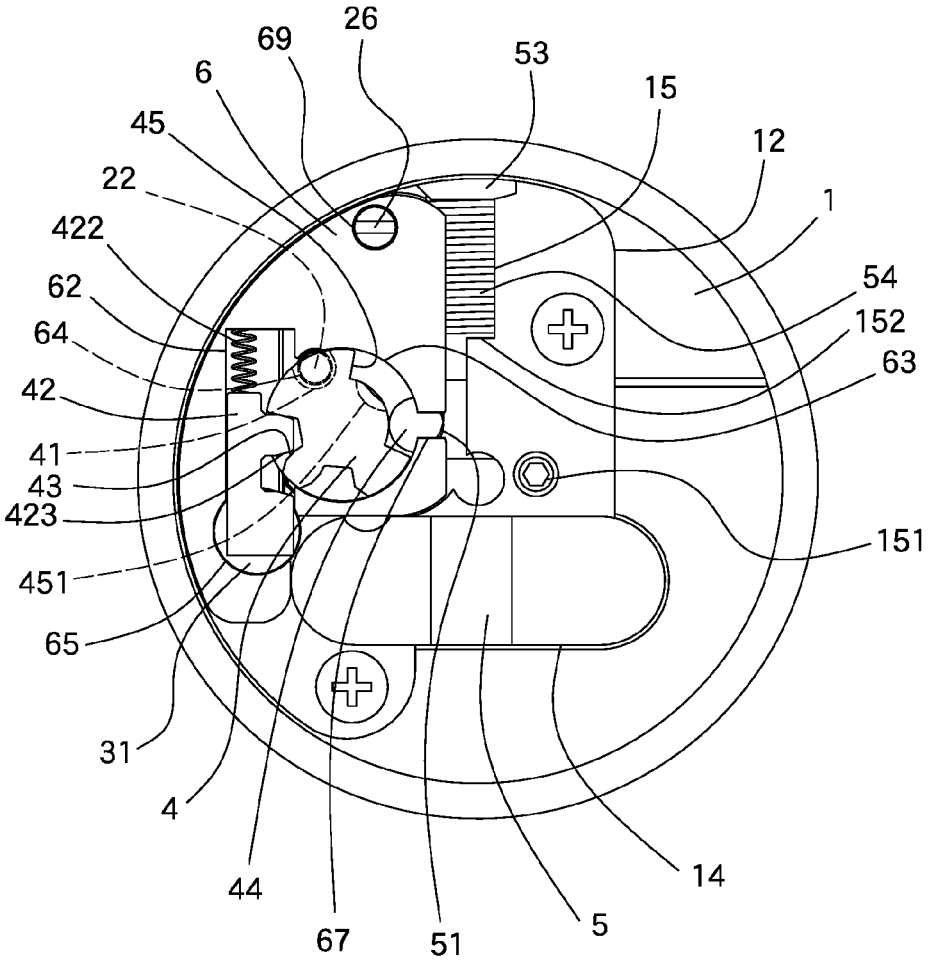
FIG. 3 shows the hockey lock of the present invention, wherein the cover is removed to disclose that the cam is positioned by the cam pin.

As shown in FIG. 3, the cover 121 is removed for clarity purpose, when the combination lock 2 is in the locked status, the number disks 21 are located at incorrect positioned. The cam pin 22 is located in the restriction hole 41 of the cam 4. Therefore, even if the button 3 is pushed, the button 3 cannot rotate the cam 4 by the lock bolt 42. The dimple 451 of the cam 4 is not located corresponding to the locking slot 67, so that the lock member 44 is in contact with the inner wall of the recess 45 and is engaged with the locking portion 51 of the latch 5, so that the latch 5 is restricted in the room 14 and cannot move.

Figure 4:
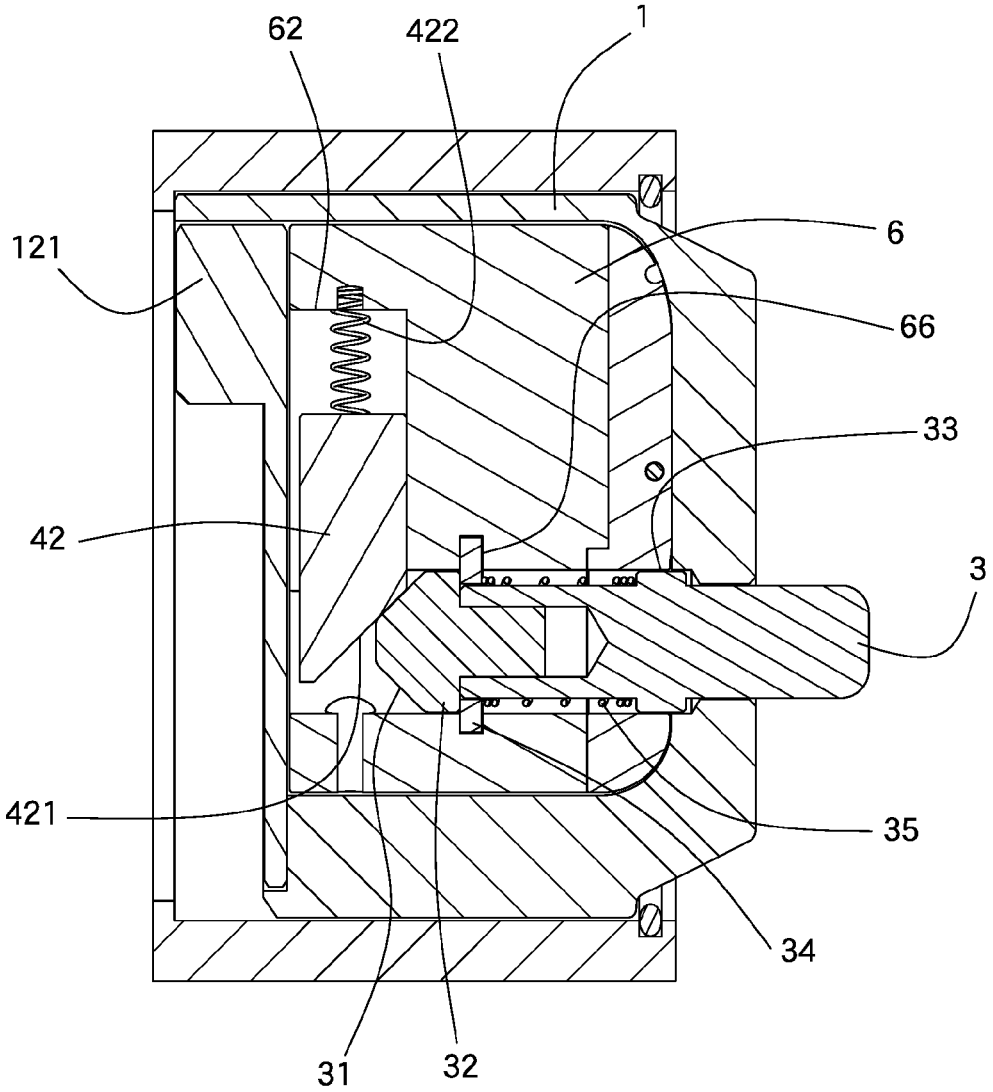
FIG. 4 is a cross sectional view to show the hockey lock of the present invention, wherein the button is not yet pushed.
Figure 5:
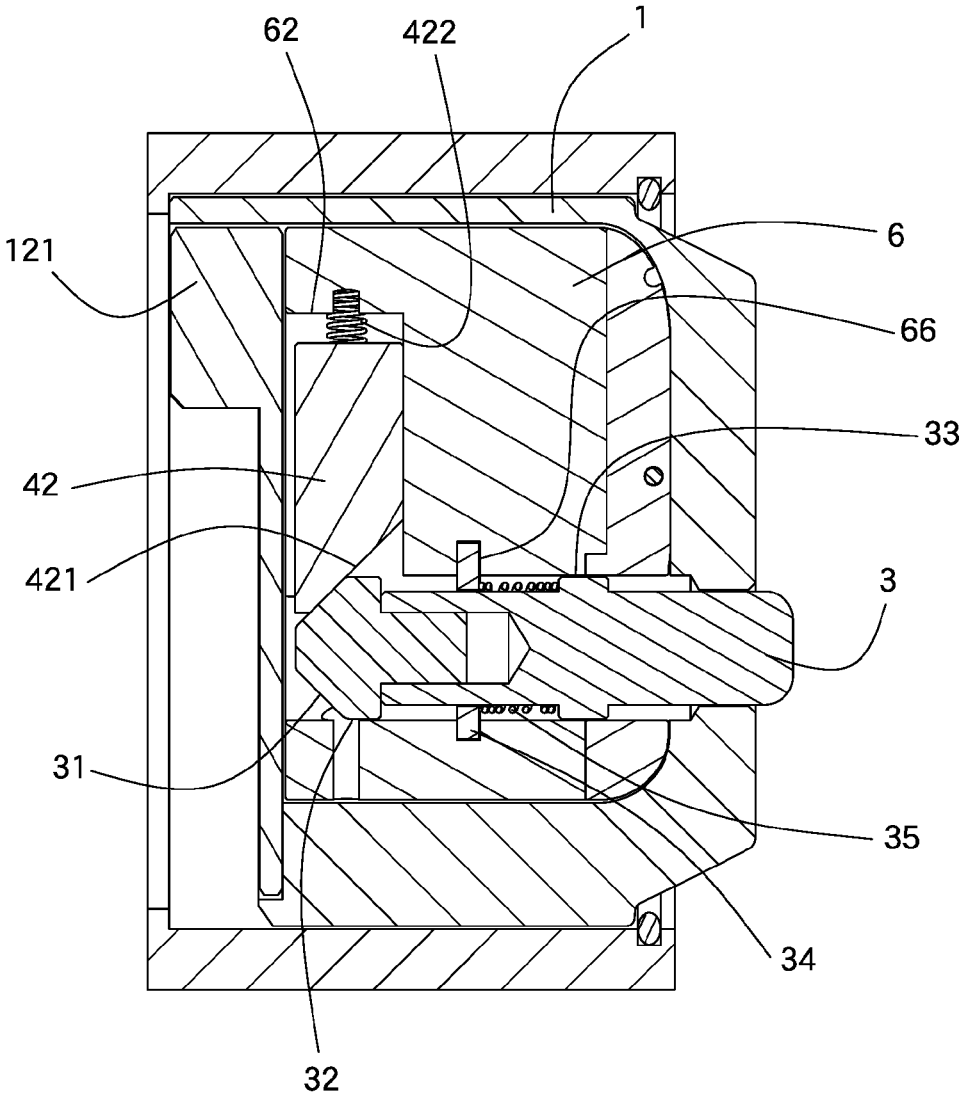
FIG. 5 shows that the hockey lock of the present invention is in the unlocked status, wherein the button is pushed.
Figure 6:
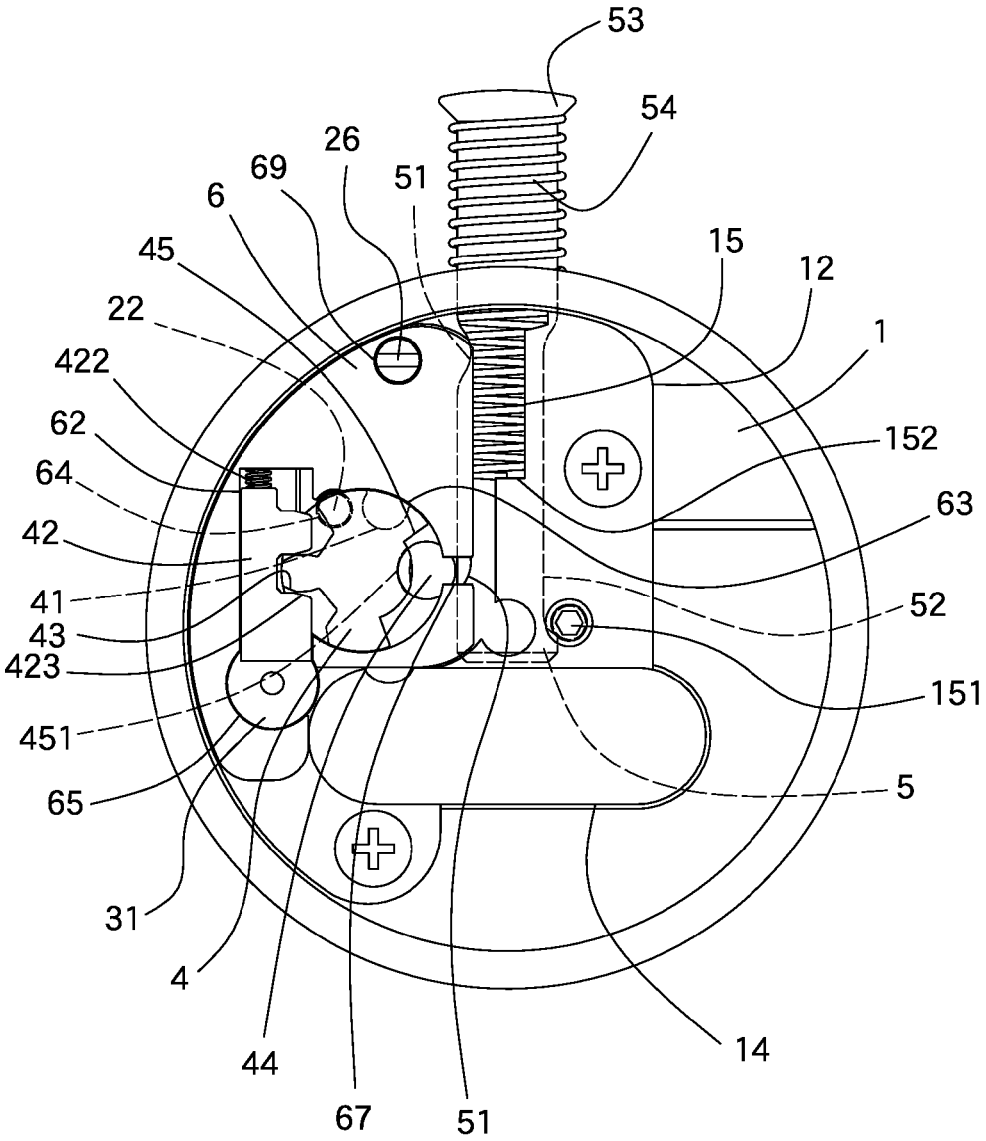
FIG. 6 shows the hockey lock of the present invention wherein the cover is removed, the cam is rotated by the lock bolt.

As shown in FIGS. 4 and 5, when the combination lock 2 is in its unlocked status, the number disks 21 are rotated to correct positions so that the cam pin 22 is activated and disengaged from the restriction hole 41 of the cam 4, as shown in FIG. 4, when the button 3 is pushed, the guide face 31 pushes the inclined face 421 of the lock bolt 42 so as to move the lock bolt 42 as shown in FIG. 6, the lock bolt 42 uses the passive member 423 to drive the passive portion 43 to rotate the cam 4, such that dimple 451 of the cam 4 is located corresponding to the locking slot 67. Therefore, the latch 5 is pushed by the elastic member 54 to move away from the room 14. The locking portion 51 is engaged with the dimple 451 by way of the lock member 44. The latch path 15 is not covered by the lock member 44, such that the latch 5 is disengaged from the room 14. The pin 151 is restricted by the restriction plane 52 of the latch 5 so that after the latch 5 is disengaged from the room 14, the latch 5 is not completely separated from the housing 1.

As shown in FIG. 5, when the button 3 is released, the elastic member 35 returns the button 3 back to its initial position. When the latch 5 is not engaged with the room 14, the lock member 44 is located in the dimple 451 of the cam 4, so that the cam 4 cannot be rotated by the lock bolt 42 due to the recovery force of the elastic member 422. The cam 4 is rotated by the lock bolt 42 when the latch 5 is engaged with the room 14 and the elastic member 422 returns, so that the lock member 44 is pushed to the locking portion 51 of the latch 5.

Figure 7:
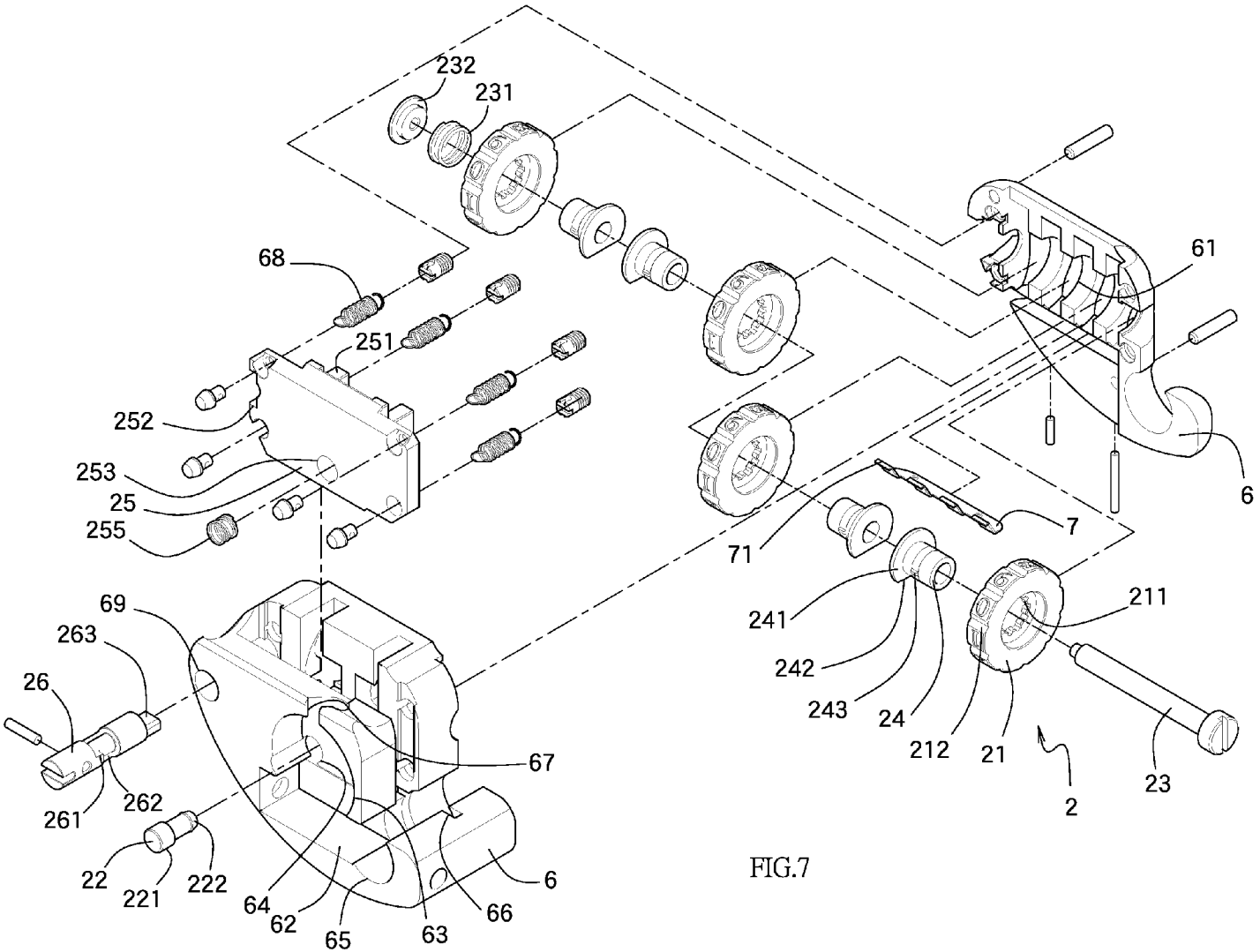
FIG. 7 is an exploded view to show the combination lock.

For the control of the cam pin 22, and the mechanism of the combination lock 2, as shown in FIG. 7, the combination lock 2 is located in a fixing base 6, and the combination unit includes number disks 21. The combination lock 2 has a shaft 23 to which the number disks 21 are mounted. Each number disk 21 has an inner member 24 connected thereto. The inner member 24 has a flange 241 extending radially therefrom and the flange 241 has a flat portion 242. The fixing base 6 has an elastic unit 68 which is connected with a stop seat 25 to which the cam pin 22 is connected. The stop seat 25 has a protrusion 251 which is located corresponding to the flange 241 and the flat portion 242 of the inner member 24. The elastic unit 68 biases the stop seat 25 toward the inner member 24.

In one embodiment, the inner member 24 has at least one lug 243 which is located at a position where the inner member 24 connects the number disk 21. The number disk 21 has teeth 211 defined in the inner periphery thereof. The teeth 211 are engaged with the at least one lug 243.

Figure 8:
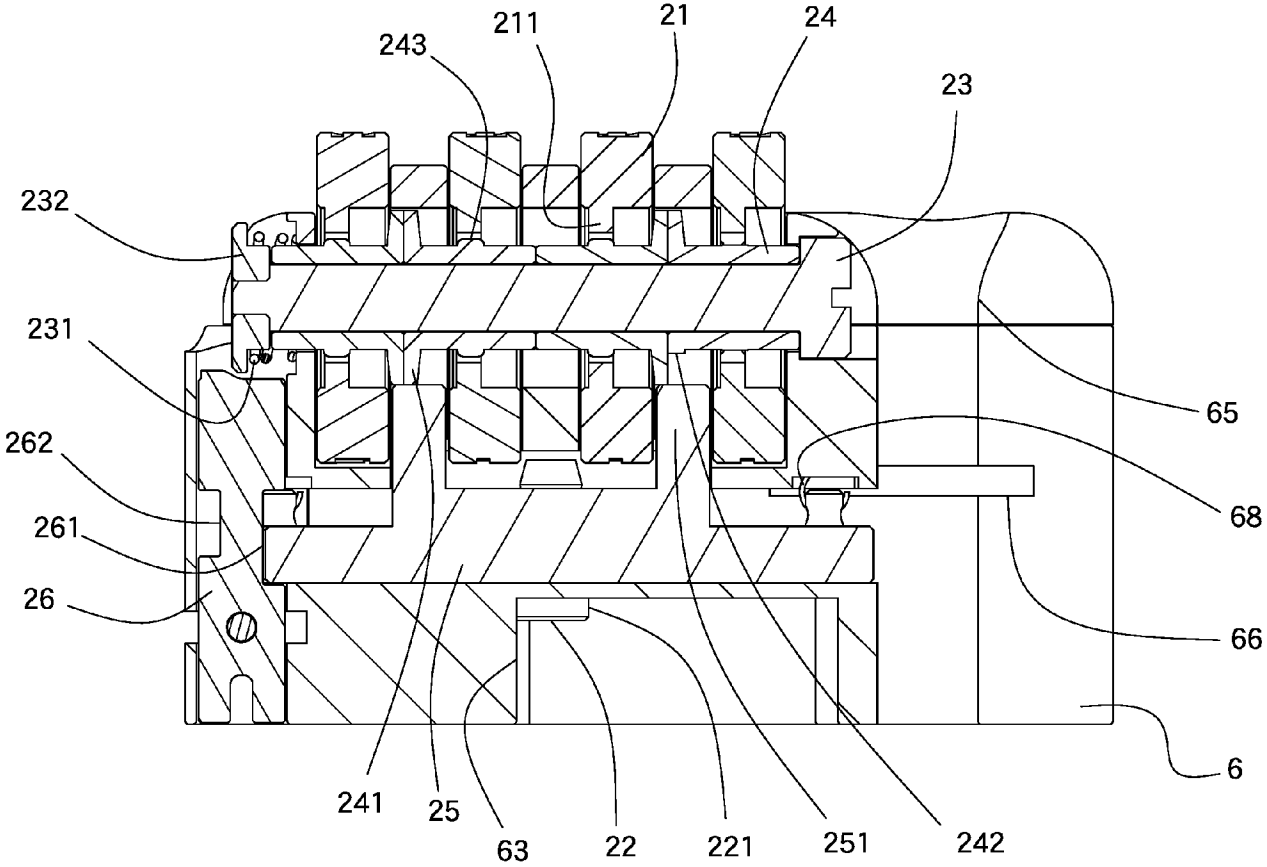
FIG. 8 is a cross sectional view of the combination lock wherein the combination lock is in the locked status.

As shown in FIG. 8, when the lock is locked, the number disks 21 are located at incorrect positions, at least one of the flanges 241 contacts one of the protrusions 251 to let the stop seat 25 be away from the inner member 24. The cam pin 22 is pushed and inserted into the reception slot 63 and is engaged with the restriction hole 41 of the cam 4, so that the cam 4 cannot be rotated.

Figure 9:
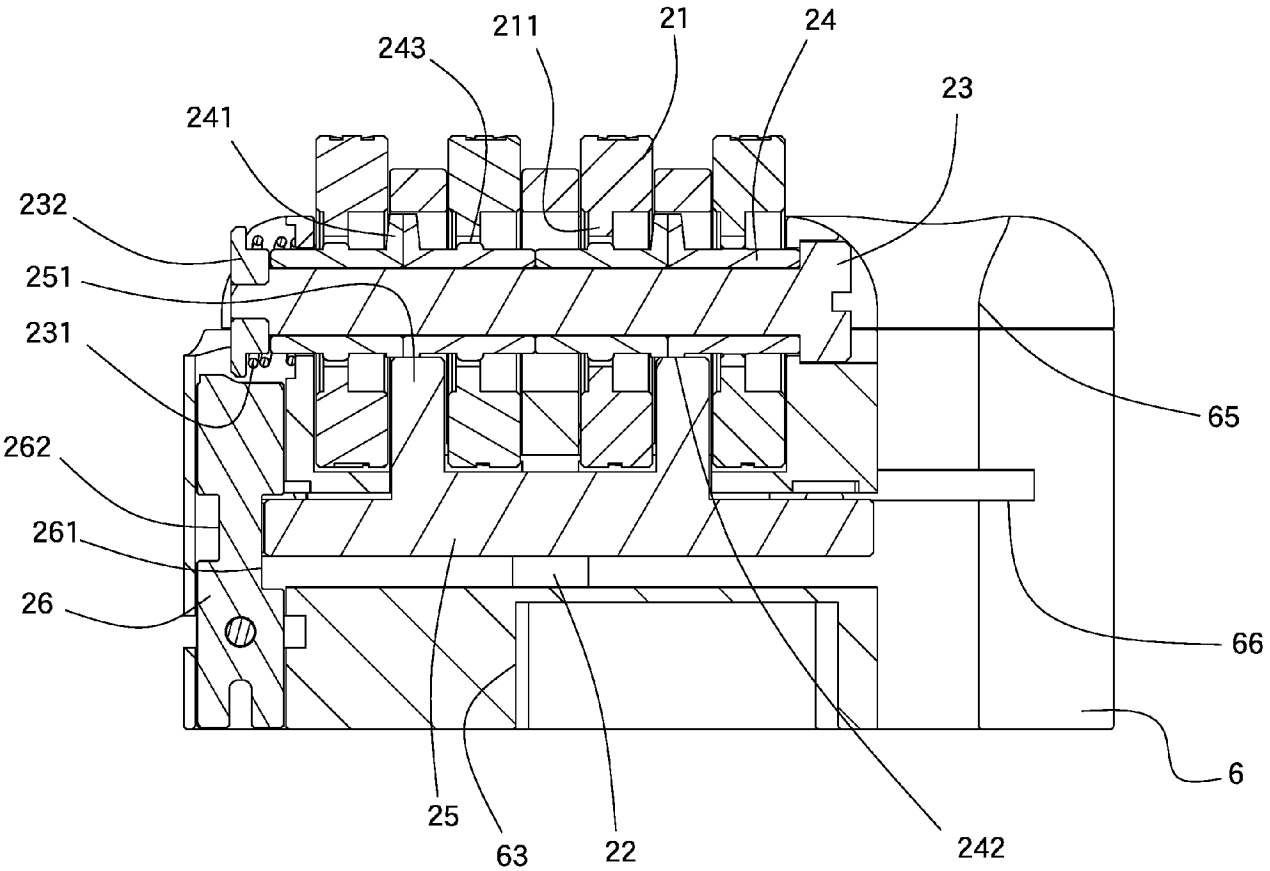
FIG. 9 is a cross sectional view of the combination lock wherein the combination lock is in the unlocked status.

As shown in FIG. 9, when the number disks 21 are located at the correct positions, the flat portion 242 of the cam 24 faces the protrusion 251 so that the protrusion 251 is pushed by the elastic unit 68 to contact the flat portion 242. Therefore, the stop seat 25 is moved close to the inner member 24, and the cam pin 22 is not inserted into the reception slot 63 and is not engaged with the restriction hole 41 of the cam 4, so that the combination lock is unlocked.

Figure 10:
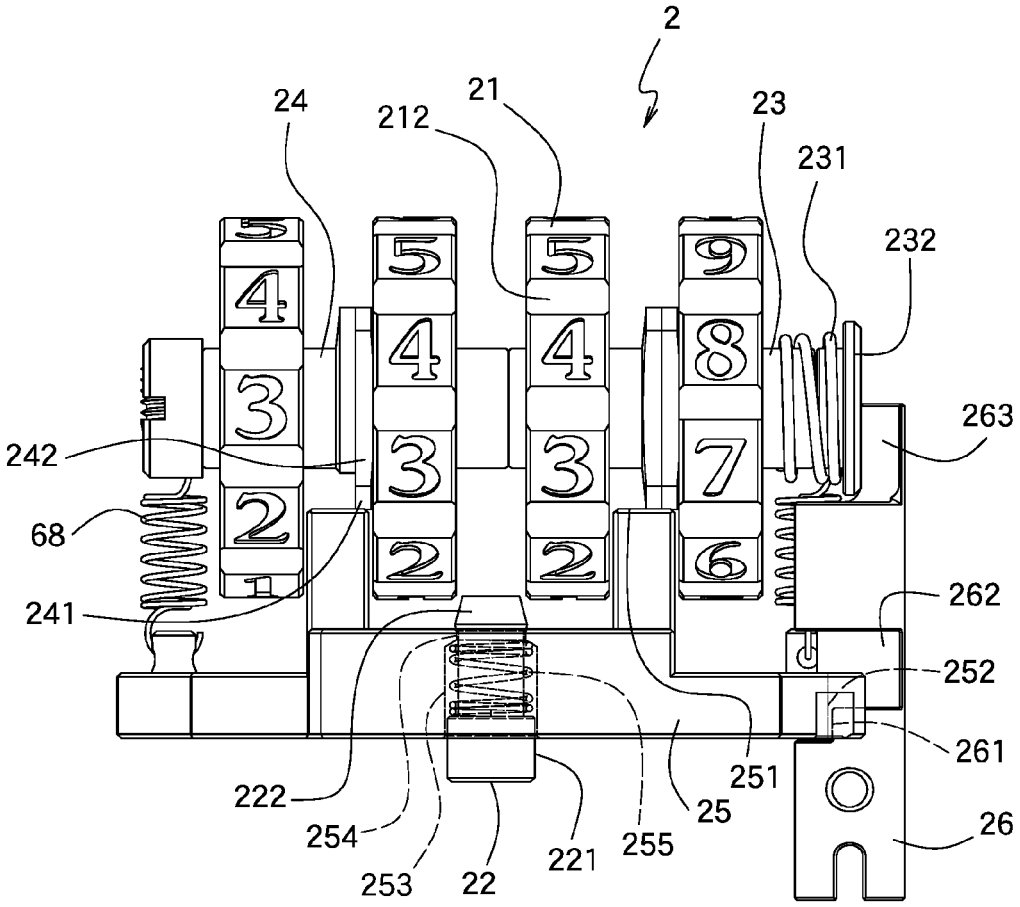
FIG. 10 shows that the combination lock wherein the combination lock is in the locked status, the stepped portion contacts the first stepped face.

The present invention has the feature of change of the combination, as shown in FIG. 7, the fixing base 6 has a pin hole 69 in which an operation bar 26 is received. The operation bar 26 is a cylindrical bar and includes a first stepped face 261 and a second stepped face 262. As shown in FIGS. 7 and 10-12, the second stepped face 262 is positioned at least 90° offset from the first stepped face 261 and the second stepped face 262 may continue as much as 180° as shown in FIGS. 8 and 9. The length of the second stepped face 262 is shorter than that of the first stepped face 261. The pin hole 69 has a push member 263 which is located close to the shaft 23 and the push member 263 is located on the same side of the operation bar 26 as the second stepped face 262. The push member 263 contacts a side of the shaft 23. The stop seat 25 has a stepped portion 252 which is located corresponding to the first and second stepped faces 261, 262 for selective engagement with the first stepped face 261 and the second stepped face 262, as shown in FIGS. 8-12. As shown in FIG. 10, the stepped portion 252 engages the first stepped face 261 with the stop seat 25 continuing tangential to the operation bar 26 and terminating. When the operation bar 26 is rotated, the push member 263 pushes the shaft 23, and the at least one lug 243 of the inner member 24 is disengaged from the teeth 211 of the number disk 21 when combination lock 2 is in the unlocked status. The shaft 23 has an elastic member 231 which biases the shaft 23 toward a direction such that the at least one lug 243 of the inner member 24 is engaged with the teeth 211 of the number disk 21.

In order to allow the push member 263 and the shaft 23 can be returned, in one embodiment, the shaft 23 has a cap 232 extending radially therefrom and the elastic member 231 of the shaft 23 is located between the number disk 21 and the cap 232 next to the number disk 21.

As shown in FIG. 10, when the lock is locked, the stop seat 25 is located away from the inner member 24, and the cam pin 22 is located in the restriction hole 41 of the cam 4, and the stepped portion 252 of the stop seat 25 contacts the first stepped face 261, so that the operation bar 26 cannot be rotated.

Figure 11:
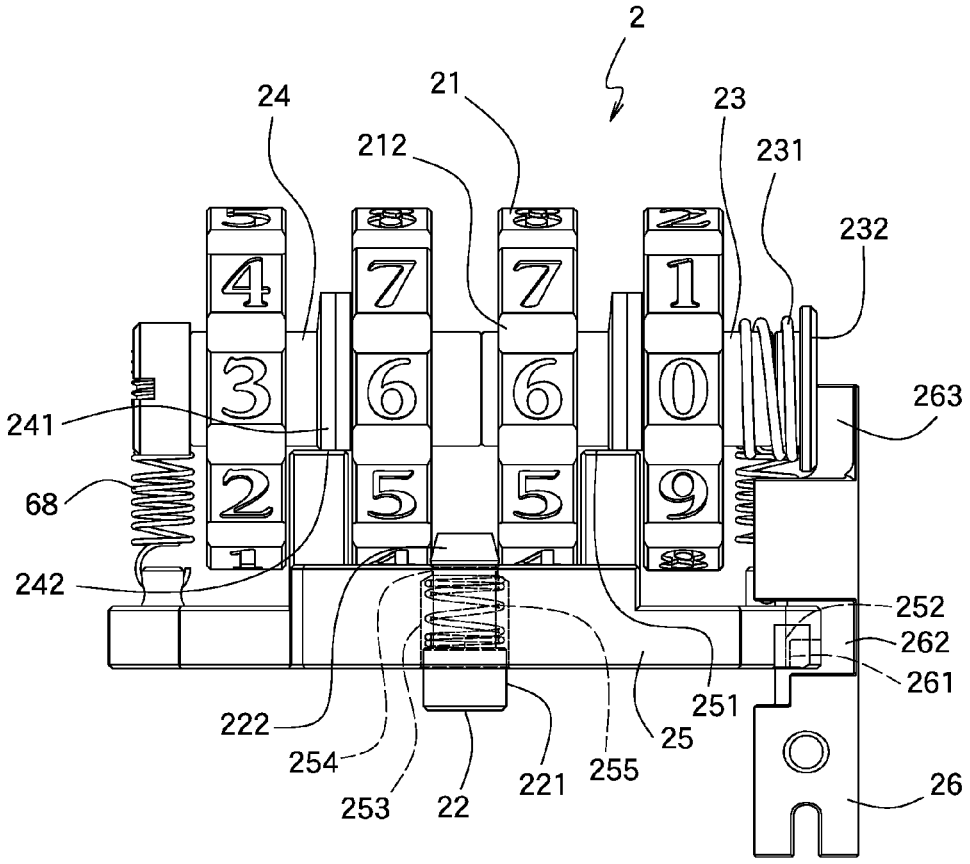
FIG. 11 shows that the combination lock wherein the combination lock is in the unlocked status, the stepped portion contacts the second stepped face.
Figure 12:
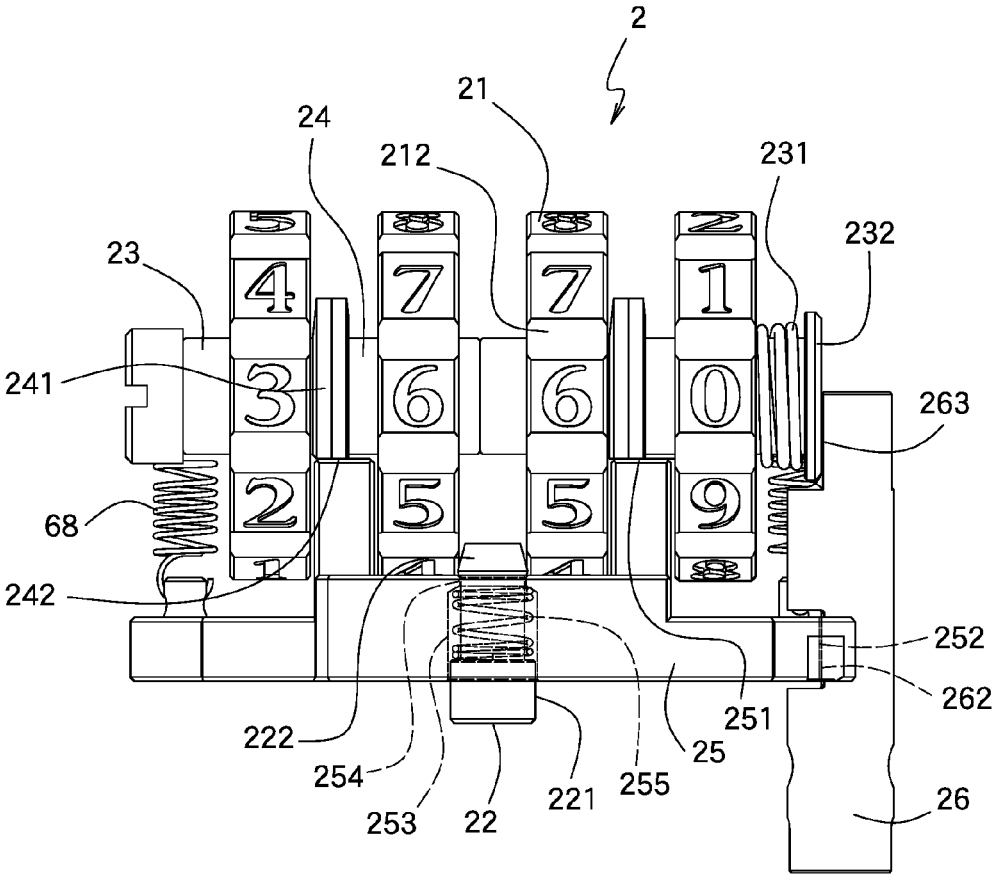
FIG. 12 shows that the combination lock wherein the combination lock is in the unlocked status, the operation bar is rotated to push the shaft.

When changing the combination, as shown in FIG. 11, the number disks 21 have to be rotated to the unlocked positions, the stop seat 25 is located close to the inner member 24. The cam pin 22 is disengaged from the restriction hole 41 of the cam 4. The stepped portion 252 of the stop seat 25 is moved to the second stepped face 262, as shown in FIG. 12. The operation bar 26 is rotated through the aperture 122 and the pin hole 69 to let the second stepped face 262 contact the stepped portion 252, and the push member 263 pushes the shaft 23 to disengage the lugs 243 of the inner member 24 from the teeth 211 of the number disk 21. At this situation, no matter how the number disks 21 are rotated, the inner member 24 is not rotated. Therefore, when the number disks 21 are rotated to desired positions to create a new combination, the operation bar 26 is rotated to its initial position, and the elastic member 231 pushes the shaft 23 to its initial position, so that the shaft 23 is located at the position as disclosed in FIG. 11, the lugs 243 of the inner member 24 are engaged with the teeth 211 of the number disk 21 to complete the steps combination change.

It is noted that when the number disks 21 rotate the inner members 24, some unauthorized persons are able to guess the correct combination by the hand touch to feel the impact between the stop seat 25 and the flange 241 or the flat portion 242 of the inner members 24. Therefore, the present invention provides a passage 253 defined in the stop seat 25 and the passage 253 has a restriction stepped face 254. The cam pin 22 has a flange 221 on the first end thereof. The flange 221 of the cam pin 22 is located corresponding to the restriction hole 41. An enlarged head 222 is connected to the second end of the cam pin 22. The enlarged head 222 extends through the passage 253. An elastic member 255 is located between the flange 221 of the cam pin 22 and the restriction stepped face 254. Even when the stop seat 25 shakes, the elastic member 255 is shaken as well to interfere or compensate for the shaking of the stop seat 25. Therefore, it is difficult to precisely guess the correct combination by hand touch. During the shaking, the cam pin 22 is not disengaged from the passage 253 because of the enlarged head 222 and the elastic member 255. The elastic member 255 only shakes slightly so that the cam pin 22 is not disengaged from the restriction hole 41 of the cam 4.

Figure 13:
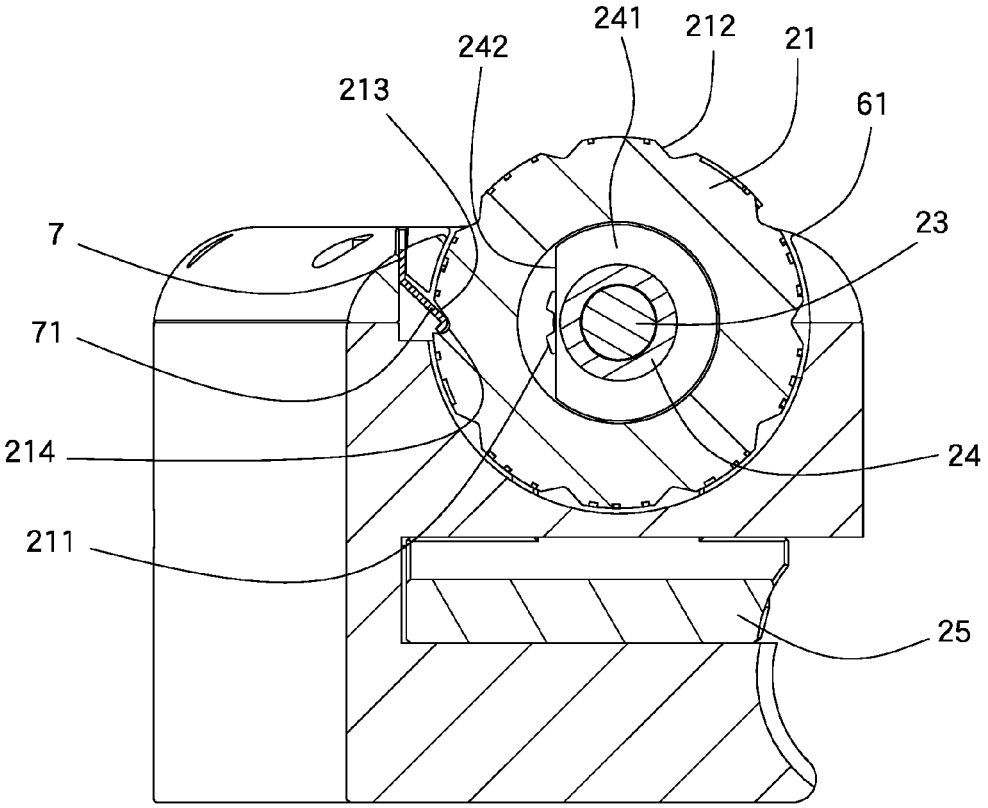
FIG. 13 shows that the pawls of the resilient plate restrict the number disks.
Figure 14:
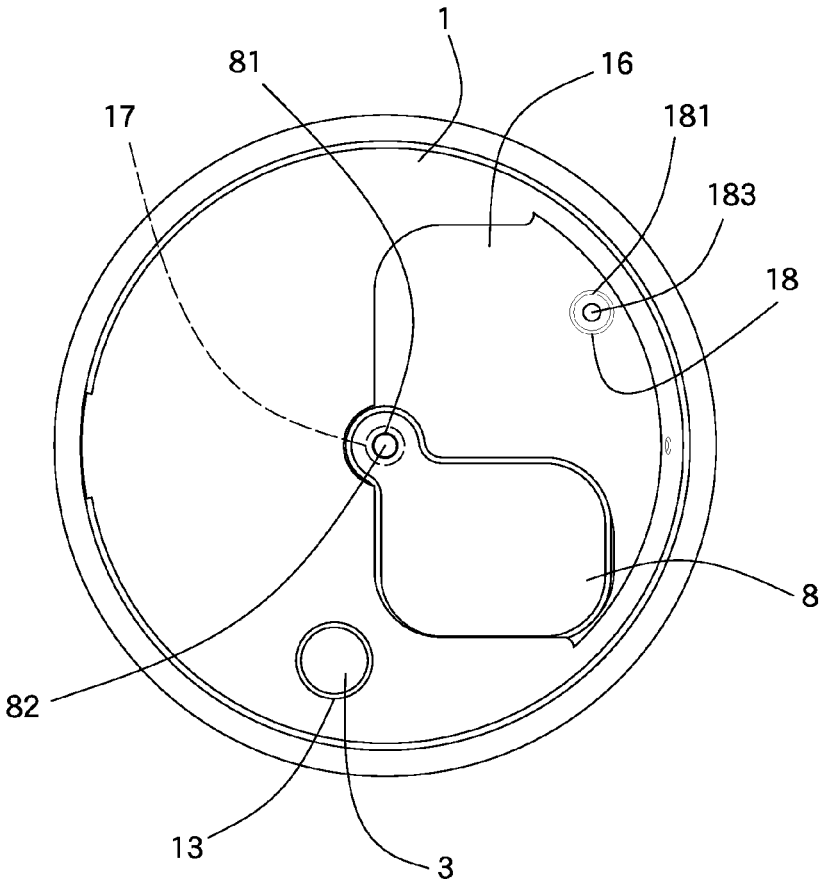
FIG. 14 shows that the slide is located at the first position to seal the lateral hole.

As shown in FIG. 13, in order to let the user to easily rotate the number disks 21 and the lock is unlocked when the number disks 21 are rotated to their correct positions, and the lock is unlocked even if the number disks 21 are slightly shifted, the number disks 21 each include multiple positioning slots 212 and a positioning recess 213 with a notch 214 which is a hook-shaped notch. The positioning slots 212 each are a V-shaped slot. A resilient plate 7 is connected to the fixing base 6 and has multiple pawls 71 which are located corresponding to the positioning slots 212 and the recess 213. Each pawl 71 extends at an angle relative to the resilient plate 7. The positioning slots 212 push the pawls 71 in two different rotational directions. The pawl 71 contacts the inner wall of the positioning recess 213 when the number disks 21 rotate in one of the two different rotational directions. As shown in FIG. 13, when rotated in the opposite direction, pawl 71 contacts notch 214 and is prevented from rotating further. Because the resilient plate 7 is located in the fixing base 6, it is preferred that the recess 213 with notch 214 be positioned between the "7" and "8", for example, so that the number on the number disks 21 can be "0" when viewed from the lateral hole 11. In this situation, the user can count engagement between the pawl 71 and the positioning slot 212 to know the numbers of the number disks 21. By this way, in a dark area, the user can still operate the correct combination to unlock the lock.

Figure 15:
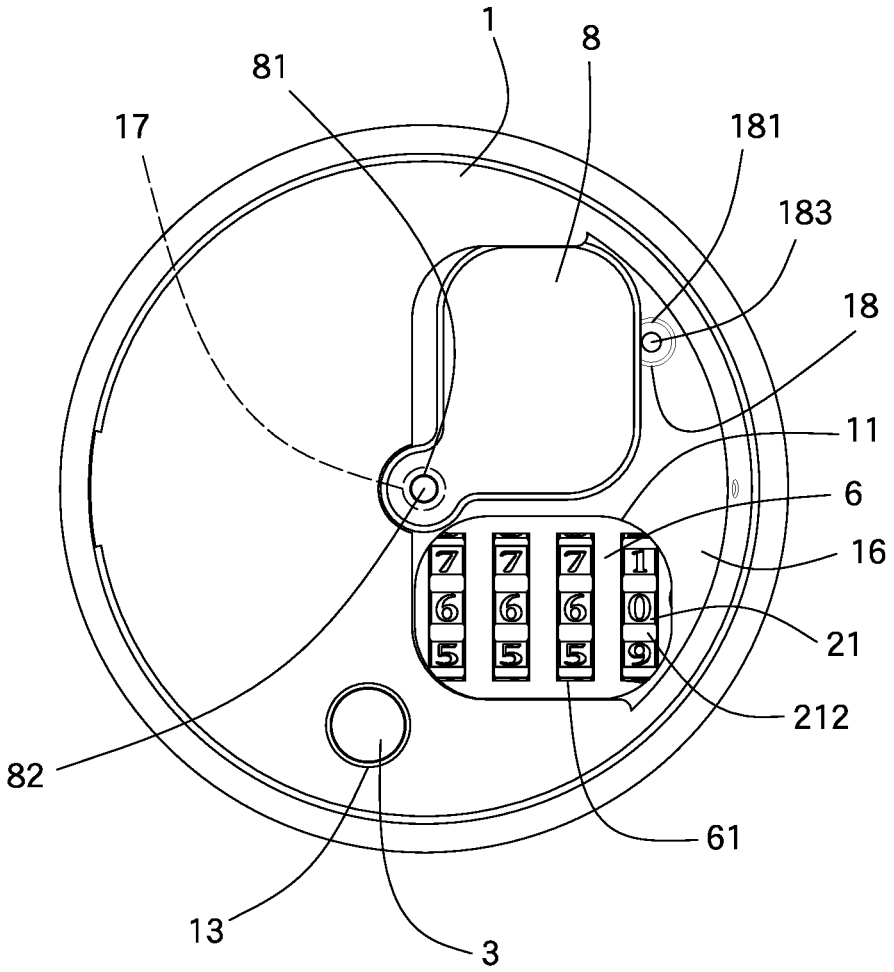
FIG. 15 shows that the slide is located at the second position to open the lateral hole.

Furthermore, in order to protect water from entering into the interior of the hockey lock via the lateral hole 11, a slide 8 is provided to be slidably connected to the housing 1. When the slide 8 is located at a first position, the lateral hole 11 is closed by the slide 8, and the lateral hole 11 is opened when the slide 8 is located at a second position. As shown in FIG. 15, when the slide 8 is located at the second position and does not seal the lateral hole 11, so that the user can operate the number disks 21 via the lateral hole 11. In order to secure the slide 8, in another embodiment, the housing 1 has a recessed area 16 which faces a path that the slide 8 moves between the first position and the second position. The depth of the recessed area 16 is substantially the same as the thickness of the slide 8.

In one embodiment, in order to ensure that the slide 8 correctly seals the lateral hole 11, the housing 1 has an assembling hole 17 and the slide 8 has a pivotal hole 81. A fixing pin 82 extends through the pivotal hole 81 and is connected to the assembling hole 17, the fixing pin 82 has an axial groove 821 and a torsion spring 822 is engaged with the axial groove 821 to provide a recovery force to the slide 8, the fixing pin 82 drives the slide 8 toward the first position.

In order to prevent the lateral hole 11 from being blocked by the slide 8 during rotation of the number disks 21, the housing 1 has a positioning hole 18 in which a positioning piece 181 is located. An elastic member 182 and a bead 183 are received in the positioning piece 181, wherein the bead 183 is biased by the elastic member 182 and protrudes from the positioning piece 181. When the slide 8 is located at the second position, the bead 183 contacts one side of the slide 8 to position the slide 8 at the second position.

While we have shown and described the embodiment in accordance with the present invention, it should be clear to those skilled in the art that further embodiments may be made without departing from the scope of the present invention.

What is claimed is:

1. A lock comprising:

a housing (1) being a cylindrical housing and having a lateral hole (11), a recessed portion (12) defined in the housing (1) and communicating with the lateral hole (11), a cover (121) connected to the housing (1) and sealing the recessed portion (12), the housing (1) having a through hole (13), a room (14) defined in one end of the lateral hole (11), a latch path (15) defined radially in the housing (1) and communicating with the room (14);

a combination lock (2) having a combination unit and received in the recessed portion (12), the combination unit having a portion thereof located corresponding to the lateral hole (11), the combination lock (2) having a cam pin (22) which is located at a first position when the combination lock (2) is in an unlocked status, the cam pin (22) located at a second position when the combination lock (2) is a locked status;

a button (3) extending through the through hole (13), a first end of the button (3) in the housing (1) actuating a cam (4) which is rotated by the button (3), the cam (4) located beside the combination lock (2), the cam pin (22) located corresponding to a restriction hole (41) within a periphery of the cam (4), the cam (4) located corresponding to a side of the latch path (15), and a latch (5) located corresponding to the latch path (15) and having a locking portion (51), when the combination lock (2) is in the locked status, the cam pin (22) is located in the restriction hole (41) to restrict the cam (4), the latch (5) is engaged with the room (14), the cam (4) is stopped by the locking portion (51), when the combination lock (2) is in the unlocked status, the cam pin (22) is removed from the restriction hole (41), the cam (4) is rotated by pushing the button (3) and the cam (4) is not stopped by the locking portion (51), and the latch (5) is removed from the room (14).

2. The lock as claimed in claim 1, wherein the button (3) is axially parallel to an axis of the cam (4), the first end of the button (3) has a guide face (31), the cam (4) is connected to a lock bolt (42) which is driven by the cam (4), the lock bolt (42) has an inclined face (421) which is located corresponding to the guide face (31), when the combination lock (2) is in the unlocked status, the button (3) is pushed, the guide face (31) contacts the inclined face (421) to push the lock bolt (42) which then rotates the cam (4).

3. The lock as claimed in claim 2, wherein the lock bolt (42) has an elastic member (422) connected to a second end thereof, the elastic member (422) biases the lock bolt (42) and provides a recovery force to the lock bolt (42) so as to set the cam (4) at a position where the combination lock (2) is in the locked status.

4. The lock as claimed in claim 2, wherein the cam (4) has a passive portion (43) which is located corresponding to the lock bolt (42), the lock bolt (42) has a passive member (423) located corresponding to the passive portion (43) which is engaged with the passive member (423).

5. The lock as claimed in claim 2, wherein the combination lock (2) is received in a fixing base (6), the fixing base (6) has at least one opening (61) in which the combination unit of the combination lock (2) is received, the at least one opening (61) is located corresponding to the lateral hole (11).

6. The lock as claimed in claim 2, wherein the combination lock (2) is received in a fixing base (6), the fixing base (6) has a bolt slot (62) and a reception slot (63) which communicate with the bolt slot (62) and the latch path (15), the lock bolt (42) is received in the bolt slot (62), the cam (4) is received in the reception slot (63), the fixing base (6) has a connection hole (64) which is located corresponding to the reception slot (63), the cam pin (22) extends through the connection hole (64).

7. The lock as claimed in claim 6, wherein the fixing base (6) has a path (65) which communicates with the bolt slot (62) and the through hole (13), the button (3) extends through the path (65).

8. The lock as claimed in claim 7, wherein the button (3) has a restriction area (32) which is located close to the guide face (31), a positioning portion (33) extends radially from a middle portion of the button (3), the fixing base (6) has a slit (66) defined therethrough which communicates with the path (65), the slit (66) has a fixing member (34) connected thereto, the fixing member (34) is positioned between the restriction area (32) and the positioning portion (33), wherein an elastic member (35) is further biased between the positioning portion (33) and the fixing member (34).

9. The lock as claimed in claim 6, wherein the fixing base (6) has a locking slot (67) and the reception slot (63) communicates with the latch path (15) via the locking slot (67), a lock member (44) is located in the locking slot (67), the cam (4) has a recess (45) defined radially therein and a dimple (451) is defined in an inside of the recess (45), the latch (5) has a head (53) which is located opposite an end of the latch (5) corresponding to the room (14), the latch path (15) has a stepped face (152), an elastic member (54) is biased between the head (53) and the stepped face (152), and pushes the latch (5) in a direction away from the room (14), when the combination lock (2) is in the locked status, the dimple (451) is not located corresponding to the locking slot (67), the lock member (44) contacts the recess (45) and is engaged with the locking portion (51) of the latch (5), when the combination lock (2) is in the unlocked status, the dimple (451) is moved by rotation of the cam (4) and located corresponding to the locking slot (67) so that the lock member (44) contacts the dimple (451) and is disengaged from the locking portion (51) of the latch (5).

10. The lock as claimed in claim 2, wherein a slide (8) is slidably connected to the housing (1), when the slide (8) is located at a first position, the lateral hole (11) is closed by the slide (8), the lateral hole (11) is opened when the slide (8) is located at a second position.

11. The lock as claimed in claim 10, wherein the housing (1) has an assembling hole (17) and the slide (8) has a pivotal hole (81), a fixing pin (82) extends through the pivotal hole (81) and is connected to the assembling hole (17), the fixing pin (82) has an axial groove (821) and a torsion spring (822) is engaged with the axial groove (821) to provide a recovery force to the slide (8), the fixing pin (82) drives the slide (8) toward the first position.

12. The lock as claimed in claim 11, wherein the housing (1) has a positioning hole (18) in which a positioning piece (181) is located, an elastic member (182) and a bead (183) received in the positioning piece (181), the bead (183) is biased by the elastic member (182) and protrudes from the positioning piece (181), when the slide (8) is located at the second position, the bead (183) contacts a side of the slide (8).

13. The lock as claimed in claim 10, wherein the housing (1) has a recessed area (16) which faces a path that the slide (8) moves between the first position and the second position.

14. The lock as claimed in claim 1, wherein the latch (5) has a restriction plane (52) which is located on a side of the latch (5) between the locking portion (51) and an end of the latch (5) corresponding to the room (14), the housing (1) has a pin (151) which is located corresponding to the restriction plane (52).

15. The lock as claimed in claim 1, wherein the combination lock (2) is located in a fixing base (6) and the combination unit includes number disks (21), the combination lock (2) has a shaft (23) to which the number disks (21) are mounted beginning with a first number disk, each number disk (21) has an inner member (24) connected thereto, the inner member (24) has a flange (241) extending radially therefrom and the flange (241) has a flat portion (242), the fixing base (6) has an elastic unit (68) which is connected with a stop seat (25) to which the cam pin (22) is connected, the stop seat (25) has a protrusions (251) which are located corresponding to each flange (241) with flat portion (242) of the inner member (24), the elastic unit (68) biases the stop seat (25) toward the inner member (24), when the combination lock (2) is in the locked status, the flange (241) contacts the respective protrusion (251) to move the stop seat (25) away from the inner member (24), when the combination lock (2) is in the unlocked status, the flat portion (242) faces the respective protrusion (251) so that the respective protrusion (251) is biased by the elastic unit (68) and contacts the flat portion (242) to move the stop seat (25) toward the inner portion (24).

16. The lock as claimed in claim 15, wherein each inner member (24) has at least one lug (243) which is located at a position where each inner member (24) is connected to the respective number disk (21), each number disk (21) has teeth (211) defined in an inner periphery thereof, the teeth (211) are engaged with the at least one lug (243).

17. The lock as claimed in claim 16, wherein the fixing base (6) has a pin hole (69) in which an operation bar (26) is received, the operation bar (26) is a cylindrical bar and includes a first stepped face (261) and a second stepped face (262), a length of the second stepped face (262) is shorter than that of the first stepped face (261), the pin hole (69) has a push member (263) which is located close to the shaft (23) and the push member 263 is located on the same side of the operation bar 26 as the second stepped face (262), the push member (263) contacts a side of the shaft (23), the stop seat (25) has a stepped portion (252) which is located corresponding to the first and second stepped faces (261, 262), the stepped portion (252) contacts the first stepped face (261) so that when the operation bar (26) is rotated, the push member (263) pushes the shaft (23), and the at least one lug (243) of each inner member (24) is disengaged from the teeth (211) of each number disk (21) when combination lock (2) is in the unlocked status, the shaft (23) has an elastic member (231) which biases the shaft (23) toward a direction such that the at least one lug (243) of each inner member (24) is engaged with the teeth (211) of each number disk (21).

18. The lock as claimed in claim 17, wherein the shaft (23) has a cap (232) extending radially therefrom, the elastic member (231) is located between the cap (232) and the first number disk.

19. The lock as claimed in claim 15, wherein the stop seat (25) has a passage (253) which has a restriction stepped face (254), the cam pin (22) has a flange (221) on a first end thereof, the flange (221) of the cam pin (22) is located corresponding to the restriction hole (41), an enlarged head (222) is connected to a second end of the cam pin (22), the enlarged head (222) extends through the passage (253), an elastic member (255) is located between the flange (221) of the cam pin (22) and the restriction stepped face (254).

20. The lock as claimed in claim 15, wherein the number disks (21) each include multiple positioning slots (212) and a positioning recess 213 with a notch 214 which is a hook-shaped notch, the positioning slots (212) each are a V-shaped slot, a resilient plate (7) is connected to the fixing base (6) and has multiple pawls (71) which are located corresponding to the positioning slots (212) and the recess (213), each pawl (71) extends at an angle relative to the resilient plate (7), the positioning slots (212) push the pawls (71) in two different rotational directions, each pawl (71) contacts an inner wall of the positioning recess (213) when the number disks (21) rotate in one of the two different rotational directions.

* * * * *